US005850843A

United States Patent [19]

Mahood et al.

[11] Patent Number: 5,850,843

[45] Date of Patent: Dec. 22, 1998

[54] UMBRELLA SUPPORTED BY VEHICLE WHEEL

[76] Inventors: Monty Mahood, 235 Follett Run Rd.; Fred A. Beardsley, 889 Hatch Run Rd., both of Warren, Pa. 16365

[21] Appl. No.: 878,059

[22] Filed: Jun. 18, 1997

[51] Int. Cl.[6] ..... E04H 15/06

[52] U.S. Cl. ..... 135/88.06; 135/16; 135/99

[58] Field of Search ..... 135/88.05, 88.06, 135/88.13, 88.15, 16, 20.1, 21, 96, 98, 99

[56] References Cited

U.S. PATENT DOCUMENTS

| | | | |
|---|---|---|---|
| D. 345,856 | 4/1994 | Johnson | D3/10 |
| 2,547,896 | 4/1951 | Wellen | 135/16 |
| 3,304,035 | 2/1967 | Davis | 135/20.1 X |
| 3,765,434 | 10/1973 | Riggs | 135/16 X |
| 3,940,099 | 2/1976 | McCleskey | 135/88.06 X |
| 4,154,254 | 5/1979 | Spencer | 135/4 A |
| 4,562,849 | 1/1986 | Sirota | 135/16 |
| 4,605,030 | 8/1986 | Johnson | 135/88.06 |
| 5,152,495 | 10/1992 | Jacinto et al. | 249/545 |
| 5,158,103 | 10/1992 | Leu | 135/88.06 |
| 5,169,111 | 12/1992 | Dunaj | 248/523 |
| 5,178,356 | 1/1993 | Schouwey | 248/519 |
| 5,241,977 | 9/1993 | Flores et al. | 135/88.06 |
| 5,261,435 | 11/1993 | Stanley et al. | 135/98 X |
| 5,287,871 | 2/1994 | Trice | 135/21 X |
| 5,390,685 | 2/1995 | McCoy | 135/19 |

FOREIGN PATENT DOCUMENTS

| | | | |
|---|---|---|---|
| 234308 | 8/1960 | Australia | 135/88.15 |
| 0810156 | 3/1959 | United Kingdom | 135/20.1 |

*Primary Examiner*—Lanna Mai

*Attorney, Agent, or Firm*—David V. Radack; Benjamin T. Queen, III; Eckert Seamans Cherin & Mellott, LLC

[57] ABSTRACT

An apparatus supported by a vehicle wheel includes a base plate positionable beneath the vehicle wheel and an umbrella mounted to the base plate. An associated method for providing shelter first includes providing an apparatus which includes a base plate and an umbrella mounted to the base plate. The method next includes positioning a vehicle wheel on the base plate so as to support the umbrella.

18 Claims, 4 Drawing Sheets

UMBRELLA SUPPORTED BY VEHICLE WHEEL

BACKGROUND OF THE INVENTION

This invention relates to an apparatus supported by a vehicle wheel for providing shelter to the vehicle or an area adjacent the vehicle, and an associated method.

An umbrella is a commonly known item that is widely used for providing shelter to people and/or property from various elements, such as, for example, rain, snow or bright sunlight. Umbrellas are available in an assortment of sizes and types ranging from small, handheld portable umbrellas for individual use to large, stationery umbrellas such as used in conjunction with outdoor furniture. In addition, various means for supporting an umbrella have been developed. For example, U.S. Pat. Nos. 5,390,685 and 5,152,495 both provide for an umbrella which may be anchored to the ground, i.e., inserting the anchoring mechanism of the umbrella directly into the ground, and U.S. Design Pat. No. 345,856 provides for an umbrella which is attachable to the body of the person using the umbrella.

Many outdoor activities require shelter from the various elements on a given occasion; especially outdoor activities which take place in or around a vehicle, such as, for example, camping, "tailgate" gatherings at various sporting events, and outdoor sales events. However, conventional umbrellas often fall short of providing adequate shelter for these types of outdoor activities. For example, the smaller, portable umbrellas may not provide sufficient shelter for a large enough area in which the outdoor activity is taking place. On the other hand, larger, stationery umbrellas, while providing shelter to a large enough area, may not be convenient or practical for use with many outdoor activities. In addition, umbrellas which are supported by being anchored to the ground may not be practical for use with outdoor activities which take place on a hard surface, such as an asphalt or concrete parking lot.

Thus, there remains a need for an umbrella that provides adequate shelter for outdoor activities, and particularly for outdoor activities taking place in or around a vehicle. The umbrella should be portable, yet large enough to provide shelter to several people and/or the vehicle about which the outdoor activity is taking place. In addition, the umbrella should be capable of being supported by the vehicle.

SUMMARY OF THE INVENTION

The invention has met or exceeded the above mentioned needs, as well as others. An apparatus supported by a vehicle wheel is provided which includes a base plate positionable beneath the vehicle wheel and an umbrella mounted to the base plate.

An associated method of providing shelter is also provided. The method first includes providing an apparatus which includes a base plate and an umbrella mounted to the base plate. The method next includes positioning a vehicle wheel on the base plate so as to support the umbrella.

BRIEF DESCRIPTION OF THE DRAWINGS

A full understanding of the invention can be gained from the following description of the preferred embodiment when read in conjunction with the accompanying drawings in which.

DETAILED DESCRIPTION

Figure 1A:
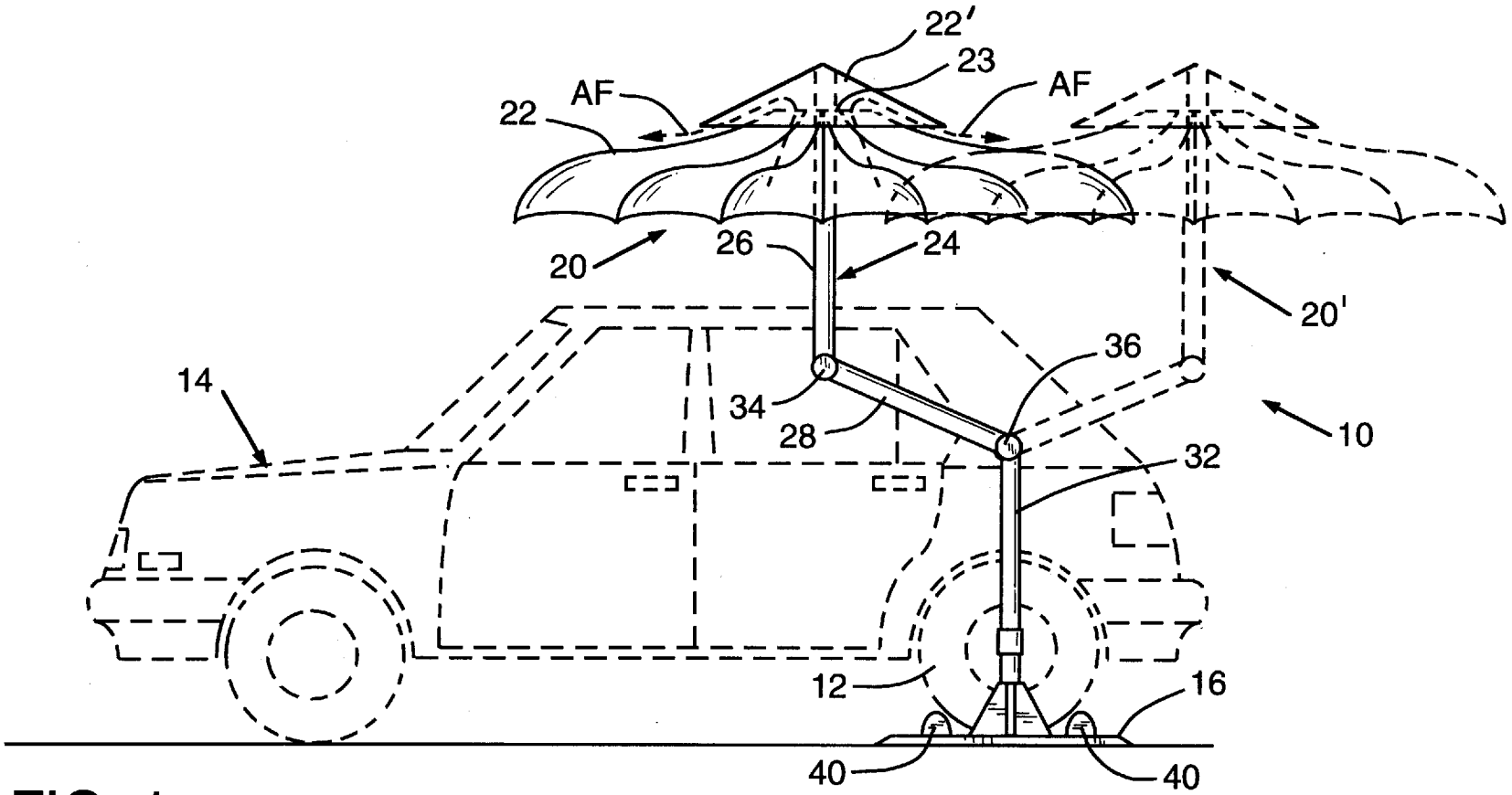
FIG. 1*a* shows a side view of a typical vehicle along with the apparatus of the present invention which is supported by a wheel of the vehicle.
Figure 1B:
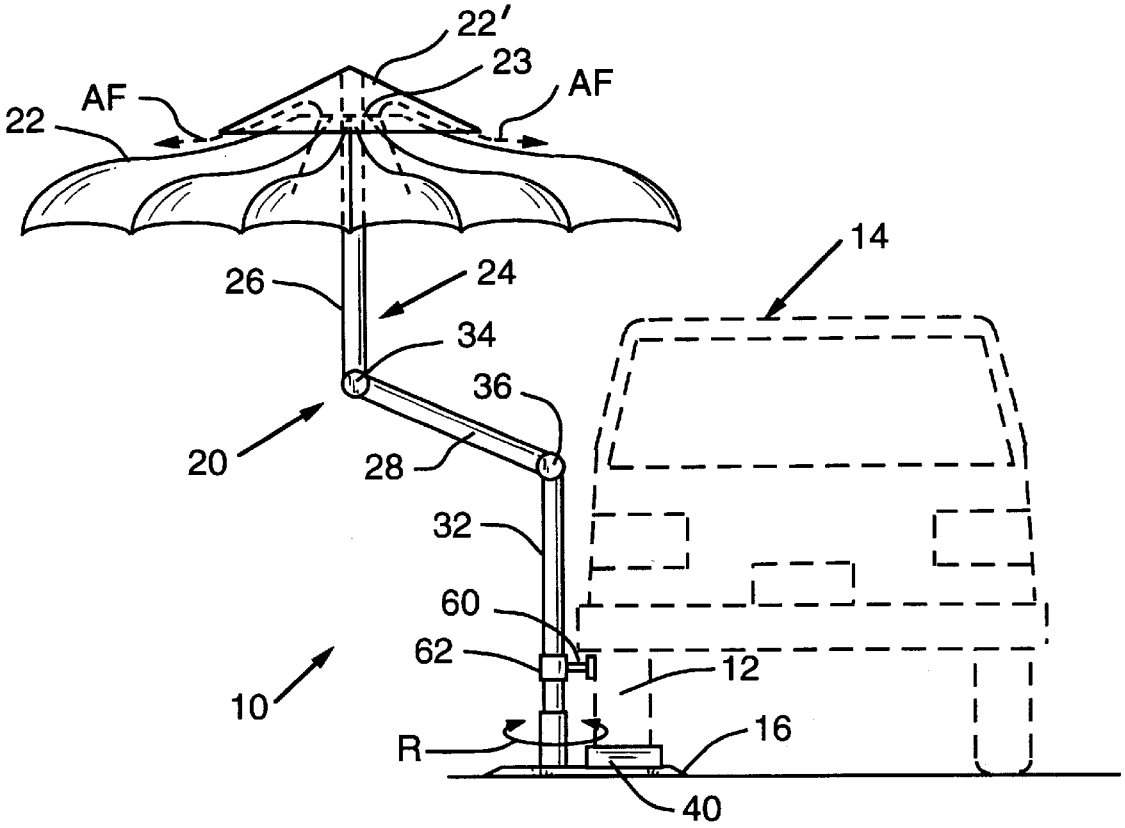
FIG. 1*b* is a rear view of a typical vehicle, similar to FIG. 1*a*, also showing the apparatus of the present invention as supported by a wheel of the vehicle.

With reference to FIGS. 1*a* and 1*b*, there is shown an apparatus 10 of the present invention. As shown, the apparatus 10 is supported by a wheel 12 of a typical vehicle 14. It should be appreciated that the vehicle 14 is provided for illustrative purposes only and that, in general, the wheel 12 of any type vehicle may be used for supporting the apparatus 10 of the present invention. In addition, it should be appreciated that more than one apparatus 10 may be provided and supported by more than one wheel of the same vehicle, as will be described in more detail herein.

The apparatus 10 includes a base plate 16 which is positionable beneath the vehicle wheel 12 and an umbrella, generally designated by the reference numeral 20, mounted to the base plate. The base plate l*b* can be made of any suitable material, such as steel. The umbrella 20 includes a main flexible cover 22 and a support shaft 24 having a first end mounted to the base plate 16 and a second end connected to the flexible cover 22. In accordance with one aspect of the invention, the umbrella 20 can include a second cover means 22' disposed above an opening 23 defined in the center of the main flexible cover 22. As can be seen in FIG. 1*b*, this arrangement permits air to flow (indicated by arrows AF) up and through the opening 23 while still providing a cover to prevent rain and sunshine from coming in through the opening 23. It will be appreciated that the air flow will prevent the umbrella 20 from being lifted from the base plate 16, thus providing greater stability to the apparatus. Although this "two tier" type umbrella 20 is disclosed herein, it will be appreciated that a conventional umbrella can be used and is within the scope of the invention. As with a conventional umbrella, umbrella 20 may be raised or lowered (not shown) and collapsed for easy storage and transportation thereof.

The support shaft 24 includes an upper section 26, a center section 28, and a lower section 32. More preferably, the upper section 26 is pivotally connected to center section 28 by first pivot joint 34 and similarly, lower section 32 is pivotally connected to center section 28 by a second pivot joint 36. Advantageously, first and second pivot joints 34, 36 allow for the support shaft 24 of umbrella 20 to pivot so as to reposition flexible cover 22 for providing shelter to different areas of the vehicle 14 and/or different areas adjacent the vehicle 14, as shown by umbrella 20' in FIG. 1*a*.

Figure 2A:
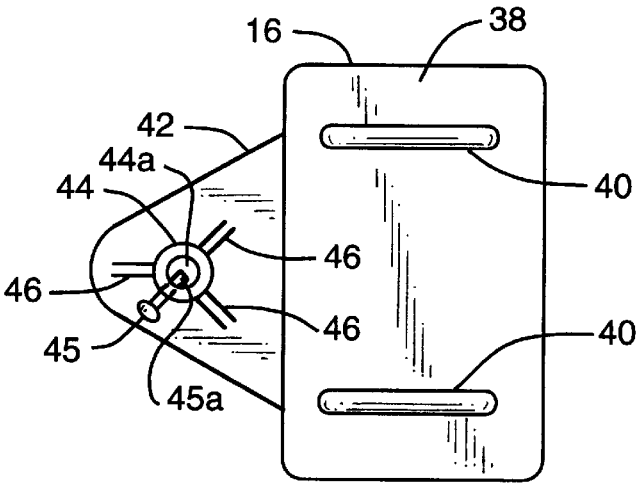
FIG. 2*a* is a top view of the base plate which is positioned beneath the wheel of a vehicle for supporting the apparatus of the present invention.
Figure 2B:
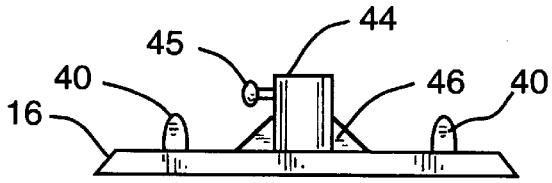
FIG. 2*b* is a side view of the base plate shown in FIG. 2*a*.

With reference to FIGS. 2*a* and 2*b*, there are shown respective top and side views of the base plate 16. Specifically, the base plate 16 includes a top surface 38 having a pair of spaced, parallel projections 40 for positioning the vehicle wheel 12 therebetween. The projections 40 are preferably constructed and arranged in order to facilitate driving of the wheel 12 of vehicle 14 in position thereon, as shown in FIGS. 1*a* and 1*b*. The projections 40 act to position the wheel 12 onto the base plate 16, however, the base plate 16 does not have to have these projections 40 in order to fall within the scope of the invention. In addition, the base plate 16 includes a lateral extension 42 extending therefrom. The lateral extension 42 includes an upright hollow, cylindrical projection 44 which is held securely to the lateral extension 42 by triangular supports 46, or similar supports as are known. The upright projection 44 provides for the support shaft 24 of umbrella 20 to be mounted to base plate 16. Preferably, the support shaft 24 is rotatably mounted in upright projection 44 thus providing for the support shaft to be rotatable 360° with respect to the base plate 16, as shown by directional arrow R in FIG. 1*b*. The upright projection 44 may include tightening key 45 which has a portion 45*a* that extends into the opening 44*a* defined by cylindrical projection 44 (see FIG. 2*a*) for securing the support shaft 24 while allowing for the support shaft to be rotated, if desired, by simply loosening the tightening key, rotating the support shaft, and then retightening. As can be appreciated, this also allows for the flexible cover 22 of umbrella 20 to be rotated 360° with respect to the base plate 16. This, in combination with the pivotal movement of the support shaft 24, enables the apparatus 10 of the present invention to provide shelter to even more areas of the vehicle 14 and areas adjacent the vehicle, as will be described in more detail herein.

Figure 3:
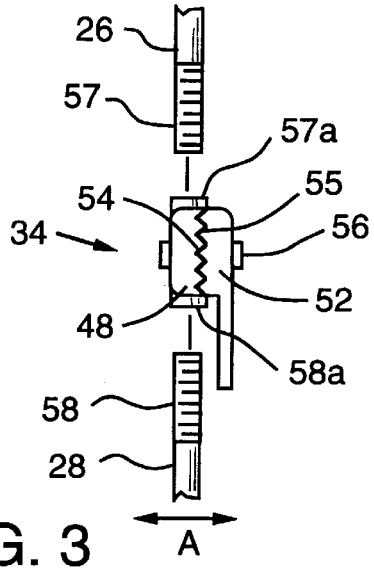
FIG. 3 illustrates a pivot joint which is used for providing pivotal movement to the support shaft of the present invention.

FIG. 3 shows a typical pivot joint 34, with pivot joint 36 being substantially identical thereto, for providing the pivotal connection between the center section 28 and upper and lower sections 26, 32 of support shaft 24. As shown, the pivot joint 34 includes means for removably connecting the sections 26 and 28 thereto where the means may include, for example, male threaded end portions 57, 58 which are threadedly received into portions 57*a* and 58*a*(having female threads). Pivot joint 36 and sections 28 and 32 are assembled similarly. This allows for the sections 26, 28 and 32 to be easily assembled and disassembled. The pivot joint 34 further includes opposed bearing surfaces 48, 52, each bearing surface 48, 52 having respective teeth 54, 55 which are disposed in an interlocking arrangement for preventing pivotal movement once the pivot joint 34 is in a set position. A spring assembly 56 extends through the opposed bearing surfaces 48, 52 so as to allow for the pivot joint 34 to be expanded, as shown by directional arrow A in FIG. 3, for pivotal movement. The spring assembly 56 further provides for the opposed bearing surfaces 48, 52 to be drawn together once the pivot joint 34 is in a set position. Once in a set position, the interlocking teeth 54, 55 prevent further pivotal movement of the opposed bearing surfaces, 48, 52 and, of course, the support shaft 24. It should be appreciated that other known types of pivot joints could be provided for use with the present invention.

Figure 4:
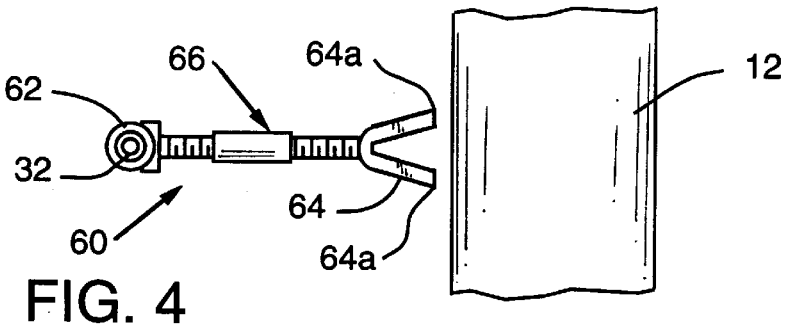
FIG. 4 is a top view of a lateral side wall support which is used in conjunction with the apparatus of the present invention for providing lateral support thereto.

In accordance with another aspect of the present invention, FIG. 1*b* and FIG. 4 shows a lateral side wall support 60 for providing lateral support between the support shaft 24 and the vehicle wheel 12. The lateral side wall support 60 preferably includes a collar 62 for mounting the side wall support to the support shaft 24, and more particularly, for mounting the side wall support to the lower section 32 of the support shaft. The opposing end of the lateral side wall support 60 includes a forked end 64 terminating in free ends designated 64*a*. The lateral sidewall support 60 also includes an adjustment means, such as turnbuckle 66, for adjusting the lateral position of the sidewall support 60. As seen in FIG. 4, the forked end 64 may be disposed in a non-contacting position adjacent the vehicle wheel 12 by adjusting the turnbuckle 66 so as to allow for engagement between the forked arrangement and vehicle wheel in the event the apparatus 10 should begin to move or sway due to, for example, gusts of wind. Alternatively, the forked end 64 may contact the vehicle wheel 12 so as to provide for constant lateral support at all times. It should be recognized that lateral adjustment means other than turnbuckle 66 could be provided for laterally adjusting the sidewall support 60, and that other arrangements besides the forked end 64 could be provided for engagement with or attachment to the vehicle wheel 12. Advantageously, it will be appreciated that lateral sidewall support 60 provides support for apparatus 10 so as prevent undesirable movement of the apparatus once assembled and placed into position.

A method of providing shelter utilizing apparatus 10 is also provided. Specifically, the method includes first providing the apparatus 10 having the base plate 16 and the umbrella 20 for mounting to the base plate. Next, the method includes positioning the vehicle wheel 12 on the base plate 16 for supporting the umbrella 20. Preferably, the base plate 16 is placed upon a substantially flat ground surface and the vehicle 14 is then driven on to the base plate 16. The vehicle 14 is ultimately positioned so that the vehicle wheel 12 is positioned between the pair of spaced, parallel projections 40. Advantageously, the projections 40 are formed on base plate 16 so as to center the wheel 12 on the base plate thus providing for uniform weight distribution of the wheel 12, and more specifically of the vehicle 14, across the base plate for supporting the umbrella 20.

The support shaft 24 of umbrella 20 is then assembled, as described herein and mounted in the upright projection 44 of base plate 16. Once the umbrella 20 is mounted to the base plate 16, the flexible cover 22 may be raised to an expanded state and repositioned so as to provide optimum shelter from the various elements, such as, for example, rain, snow, or sunlight. More specifically, the flexible cover 22 of umbrella 20 may be repositioned to provide shelter to different areas of the vehicle 14 and/or different areas adjacent the vehicle. Advantageously, the pivotal movement provided by pivot joints 34, 36 between the center section 28 and upper and lower sections 26, 32 of support shaft 24, as shown in FIGS. 1*a* and 1*b*, allows for a high degree of flexibility in repositioning the flexible cover 22 of umbrella 20. In addition, rotatably mounting the support shaft 24 to the upright projection 44 of base plate 16 for 360° rotation with respect thereto advantageously provides even further repositioning capabilities.

Figure 1C:
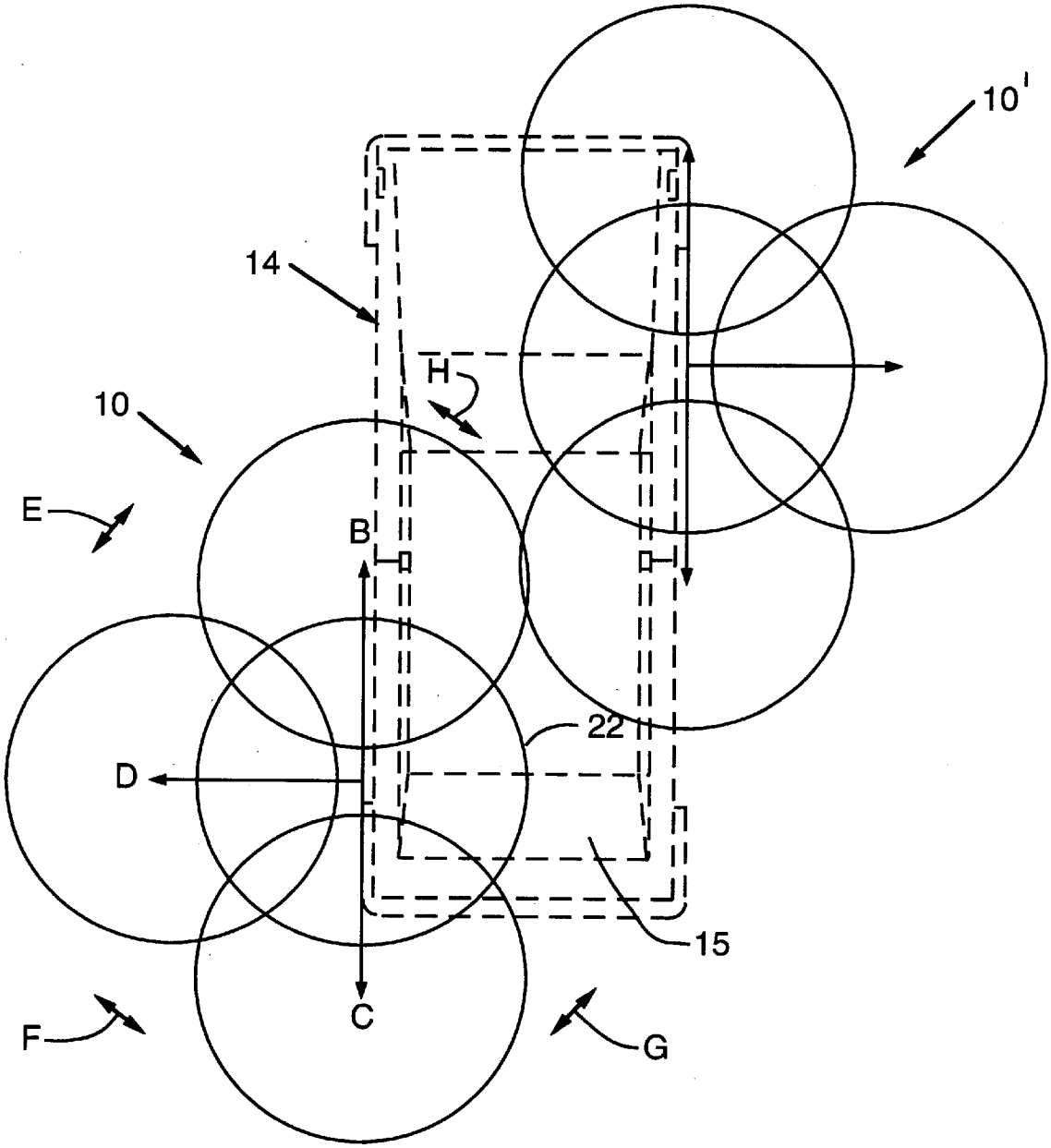
FIG. 1*c* is a schematical top view of a typical vehicle showing the positioning capabilities of the apparatus of the present invention in relation to the vehicle.

Referring to FIG. 1*c*, there is shown a schematic view of a top surface 15 of the vehicle 14 illustrating the repositioning capabilities of the apparatus 10 of the present invention. When the umbrella 20 is mounted to the base plate 16, the support shaft 24 may be entirely in a vertically upright position resulting in the flexible cover 22 being in the position shown in FIG. 1*c*. By then pivotally operating the pivot joints 34, 36, as described herein, the flexible cover 22 may be moved, for example, in the direction of arrows B, C and D, as well as other directions, in order to provide shelter to various parts of the vehicle 14 and the areas adjacent the vehicle. In addition, the flexible cover 22 may be moved, for example, in the directions of arrows E, F, G and H as a result of the support shaft 24 being rotatably mounted to the upright projection 44 of baseplate 16. Thus, it should be appreciated that the umbrella 20, and particularly flexible cover 22, is able to provide shelter to several different areas of the vehicle and/or areas adjacent the vehicle 14. FIG. 1*c* also shows that more than one apparatus, such as apparatus 10', may be provided for use with the same vehicle 14.

It will be appreciated that the apparatus 10 can be easily stored and transported by disassembling the sections 26, 28, 32 from respective pivot joints 34, 36 and placing these along with the collapsed umbrella in a draw string nylon bag or the like. The base plate 16 can then be stored separately.

In summary, numerous benefits result from employing the concepts of the present invention. The apparatus 10 of the present invention is particularly user friendly and convenient to assemble and place into operation to provide adequate shelter for outdoor activities, and particularly for outdoor activities taking place in or around a vehicle 14. Advantageously, the apparatus 10 is portable, yet capable of providing adequate shelter to several people and/or the vehicle 14 about which the particular outdoor activity is taking place. In addition, the apparatus 10 advantageously makes effective use of the vehicle 14, and particularly the vehicle wheel 12, to provide adequate support for the apparatus and its use during an outdoor activity where shelter is needed but no other means of support may be available.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An apparatus supported by a vehicle wheel comprising a base plate positionable beneath said vehicle wheel;

an umbrella mounted to said base plate;

said umbrella includes a support shaft having a first end mounted to said base plate and a second end connected to a flexible cover for providing shelter;

said support shaft comprising a lower section an upper section, and a center section between said lower and upper sections, said lower section pivotally connected to a first end of said center section, said upper section pivotally connected to a second end of said center section;

said lower section is pivotally connected to said center section by a first pivot means and said upper section is pivotally connected to said center section by a second pivot means;

said first and second pivot means including a pivot joint having opposed first and second bearing surfaces, said first and second bearing surfaces having means for locking said first and second pivot joints in a set position;

said first pivot means including means for removably connecting said lower section to said center section and said second pivot means includes means for removably connecting said upper section to said center section;

said lower section threadedly connected to said first pivot means;

said first end of said center section threadedly connected to said first pivot means;

said second end of said center section threadedly connected to said second pivot means; and said upper section threadedly connected to said second pivot means, whereby said upper, center and lower sections can be disassembled from said first and second pivot means, respectively, in order to store or transport said apparatus.

2. The apparatus of claim 1, wherein said base plate includes a top surface, said top surface having a pair of spaced, parallel projections for positioning said vehicle wheel therebetween.

3. The apparatus of claim 1, wherein said base plate includes a lateral extension, said lateral extension having an upright projection for mounting said umbrella to said base plate.

4. The apparatus of claim 3, wherein said umbrella is rotatably mounted to said upright projection, said umbrella being rotatable 360° with respect to said upright projection.

5. The apparatus of claim 3, wherein said upright projection includes a tightening key for securing said umbrella into said upright projection.

6. The apparatus of claim 1, wherein said lateral support means includes an adjustment means for adjusting the lateral position of said lateral support means.

7. The apparatus of claim 1, wherein said umbrella includes a first cover means defining a central opening and a second cover means covering said central opening.

8. An apparatus supported by a vehicle wheel comprising a base plate positionable beneath said vehicle wheel;

an umbrella mounted to said base plate;

said umbrella including a support shaft having a first end mounted to said base plate and a second end connected to a flexible cover for providing shelter; and a lateral support means having one end connected to said support shaft, said lateral support means extending from said support shaft towards said vehicle wheel and terminating in a free end.

9. The apparatus of claim 8, wherein said free end is a forked end for engaging said vehicle wheel.

10. The apparatus of claim 6, wherein said adjustment means is a turnbuckle.

11. The apparatus of claim 9, wherein said umbrella includes a first cover means defining a central opening and a second cover means covering said central opening.

12. The apparatus of claim 8, wherein said base plate includes a top surface, said top surface having a pair of spaced, parallel projections for positioning said vehicle wheel therebetween.

13. The apparatus of claim 12, wherein said free end is a forked end for engaging said vehicle wheel.

14. The apparatus of claim 8, wherein said base plate includes a lateral extension, said lateral extension having an upright projection for mounting said umbrella to said base plate.

15. The apparatus of claim 14, wherein said umbrella is rotatably mounted to said upright projection, said umbrella being rotatable 360° with respect to said upright projection.

16. The apparatus of claim 14, wherein said upright projection includes a tightening key for securing said umbrella into said upright projection.

17. The apparatus of claim 16, wherein said lateral support means includes an adjustment means for adjusting the lateral position of said lateral support means.

18. The apparatus of Claim 17, wherein said adjustment means is a turnbuckle.

* * * * *